United States Patent [19]

Cavalaris et al.

[11] 4,175,602

[45] Nov. 27, 1979

[54] BAG HOLDER AND DISPENSER

[76] Inventors: Michael T. Cavalaris, 1733 Nebraska Ave., Palm Harbor, Fla. 33563; Michael E. Spanondis, P.O. Box 1547, Tarpon Springs, Fla. 33589

[21] Appl. No.: 914,214

[22] Filed: Jun. 9, 1978

[51] Int. Cl.[2] ..... A45C 13/00

[52] U.S. Cl. ..... 150/3; 248/97; 248/99; 248/100

[58] Field of Search ..... 150/51, 3, 1; 248/97, 248/98, 99, 100

[56] References Cited

U.S. PATENT DOCUMENTS

| | | | |
|---|---|---|---|
| 447,686 | 3/1891 | Holladay | 248/100 |
| 804,199 | 11/1905 | Ballou | 248/97 |
| 1,260,620 | 3/1918 | Armstrong | 248/97 |
| 2,188,047 | 1/1940 | Jones | 248/99 |
| 2,505,289 | 4/1950 | Haslett | 248/99 |
| 2,995,329 | 8/1961 | Talcott | 248/100 |
| 3,161,391 | 12/1964 | Bahnsen | 248/99 |
| 3,374,976 | 3/1968 | Kurlander | 248/97 |
| 3,388,882 | 6/1968 | Burroughs | 248/97 |
| 3,439,891 | 4/1969 | Pinto | 248/100 |
| 3,861,630 | 1/1975 | Ady | 248/100 |

FOREIGN PATENT DOCUMENTS

| | | | |
|---|---|---|---|
| 94734 | 2/1939 | Sweden | 248/97 |

*Primary Examiner*—Ro E. Hart

*Attorney, Agent, or Firm*—Birch, Stewart, Kolasch & Birch

[57] ABSTRACT

A frame for holding flexible bags to be opened and filled comprising bendable rods in continuous side frame formations. These side frame formations in one embodiment may be Z-shaped and are spaced with respect to each other and joined together by a telescopic rod at their respective lower foot extremities formed with aligned toed-in or inboard continuations of the foot extremities. The side frame formations at their respective upper top portions are each made with special forwardly extending arms provided with bag storage and holding formations. The bags to be supported on the arms include resilient and flexible material with stiffened portions in the form of an integral zipper around the opposed lip edges of the bag mouth. The relatively thicker lip edges are formed with spaced corner openings to mate with the free ends of the forwardly extending arms of the side frames of the bag support. In use the bag mouth lip edges are bowed and spread apart in lip-like fashion to open the mouth of the bag by movement of the bag carrier or support arms toward each other by a transverse link coupled to each mid-part of the side frames. The link may comprise a pedal manually operated by downward movement, such as by hand or foot pressure to thereby move the spaced support arms inwardly and open the bag. When the pressure on the link is released the resiliently flexible arms return to their prior normal position and the mouth of the bag may be closed and sealed together by the fastener parts and then removed and replaced by another bag for a subsequent filling operation.

7 Claims, 10 Drawing Figures

BAG HOLDER AND DISPENSER

BACKGROUND OF THE INVENTION

1. Field of the Invention

This invention relates to a novel bag support arrangement created for holding and opening the mouth of flexible bags, such as plastic bags to facilitate the filling thereof with selected articles. Such plastic bags, for example, include a relatively more rigid two ply top closure portion of a sealable zipper type or any suitable press fit closure. The closure portion of the bag has the combined propertities of semi-rigidity and flexibility.

2. Description of Prior Art

The prior art has attempted to provide bag supports to accomplish the results above outlined. Illustrative of prior art bag holders are the following representative U.S. Pat. Nos., namely: 203,891 Conway, patented May 21, 1878; 1,145,297 Eridsson et al, patented July 6, 1915; 1,350,443 Edstrom, patented Aug. 24, 1920; 2,790,591 Rosen, patented Apr. 30, 1975; 3,388,882 Burroughs et al, patented June 18, 1968; 3,439,891 Pinto, Apr. 22, 1969 and 3,646,723 Merony, patented Mar. 7, 1972. However, such prior art arrangements have not provided for bag supply from a storage station to a filling station of the bag holder, in combination, with efficient means for lateral movement of the bag holder support arms to open the bag mouth and retain the same open while introducing articles into the same.

SUMMARY OF THE INVENTION

In a preferred embodiment the present invention is comprised of two side frames, each of a continuous Z-shaped formation with a relatively longer substantially horizontal lower foot section and a substantially horizontal upper shorter top or arm section angularly joined by a connecting mid-section continuously extending from the front of the lower foot section to the rear of the upper arm section. The rear of each lower foot section of each side frame is formed with a toed-in section to provide opposed connections when engaged in the opposite ends of a tubular connector rod. This rod includes in one embodiment lock means, such as a set screw to retain the side frames together in desired adjusted position to accomodate for any desired size of bag to be supported in the erected bag support. The side frames may be coupled together with a transverse linkage means with a foot pedal in the middle thereof. Depression of the pedal will move the side frames together for reasons to become more fully apparent hereinafter.

Also, a novel form of bag mouth is provided to suspend the bag from the frame arms. For example, the arm ends when moved toward each will serve to compress the top lips or two-ply taped edges of a bag mouth suspended at two points only on the spaced arms, to thereby bow open the bag mouth edges to accomodate for loading the suspending bag. The bag mouth includes an integral plastic zipper.

The support arms are fabricated with an elongated storage section for extra bags inboard of the arm ends which ends may be made into hooks to provide for cooperation with a hole at each end of the bag mouth closure. Thus, as a supported bag mouth is opened and filled at the end of the arms, it may be readily replaced by simply sliding another bag from the storage section onto the terminal ends of the support for a continuous filling operation.

It is an object of the present invention to provide a positive improvement in prior art bag holders for simplication of the support of a bag with a flexible body and a novel mouth, whereby the manipulation of the mouth of the bag to an open position to receive material, such as trash or the like, and for any subsequent loading and sealing of the open bag into sealed loaded condition is accomplished with minimal effort and maximum efficiency.

Another object is to provide a novel flexible bag support and magazine storage arrangement for extra bags, whereby single bags are selectively positioned on the support until replaced after filling with material and subsequently an extra bag is slidable into filling position to replace the previously filled bag which has been removed from the bag support filling position.

Still another object is to provide a novel bag support frame in combination with a novel bag made of flexible material, such as plastic having an open top or thicker lip portions formed with spaced suspension openings in each corner of the bag mouth, which lip portions are yieldable in response to movement of spaced support arms projecting into each of said spaced openings to bow open the top lip portions of the bag mouth.

Yet another object of the present invention is to provide a novel bag support arrangement, whereby successive bags to be filled may be dispensed from a storage position to a filling and opening station, in combination, with manually operated pedal means to bow open the mouth of a bag supported at the filling and opening station.

These and other objects and advantages of the present invention will be apparent from the accompanying drawings and following specification and claims.

BRIEF DESCRIPTION OF THE DRAWINGS

Referring to the drawings in which like characters refer to like characters of reference throughout the several views of the accompanying drawings.

Figure 1:
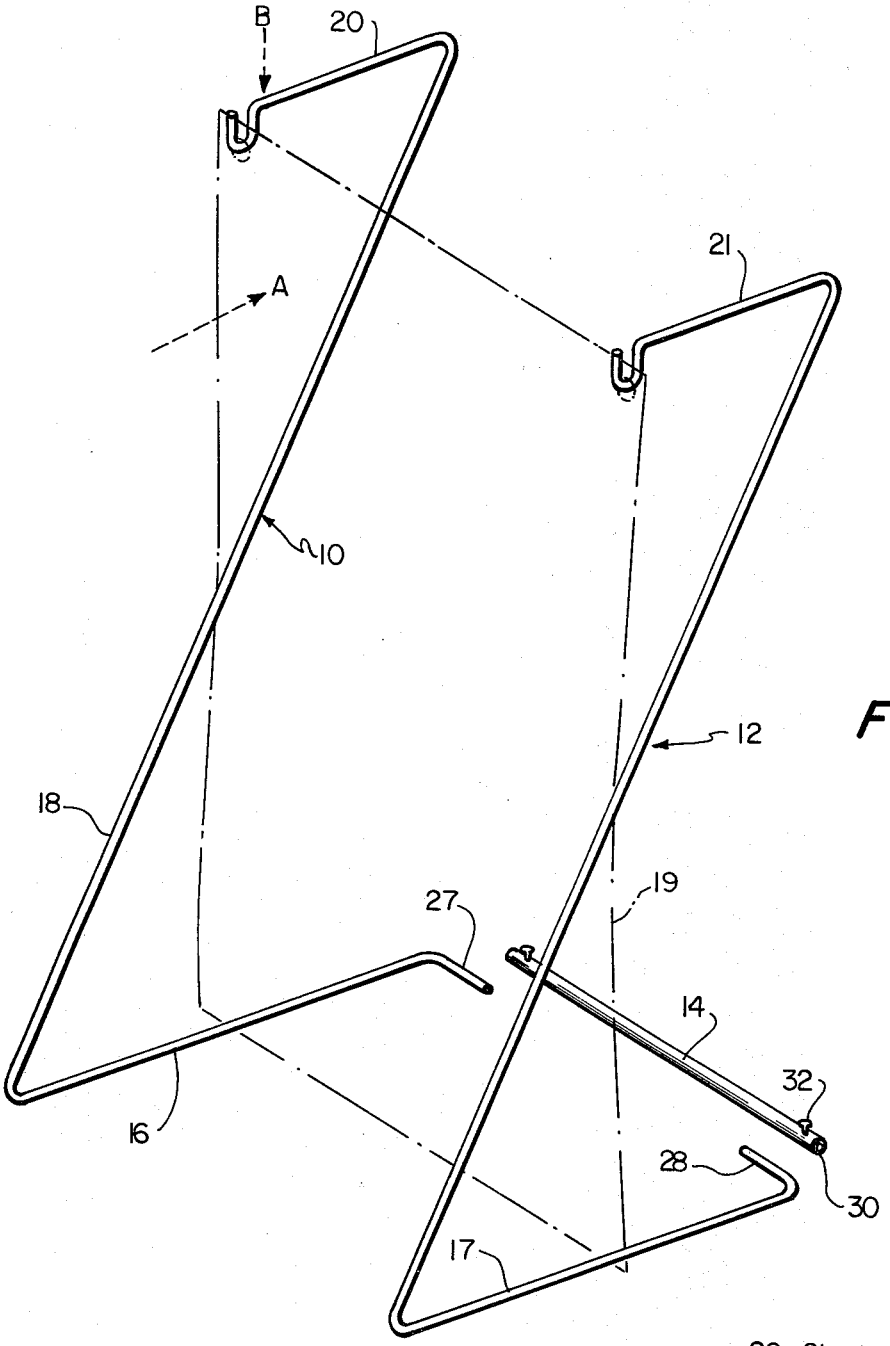
FIG. 1 is a front perspective view of a first embodiment of a Z-shaped bag support in accordance with the present invention.

Referring in detail to the accompanying drawings and first with reference to FIG. 1 there is shown a first embodiment of bag support with side frames 10 and 12 positioned apart for assembly at the lower portions of the frames by a transverse connector bar 14. Each of the side frames 10 and 12 are of identical Z-shaped configuration and made from one continuous piece of bendable wire or rod with a lower foot portion 16 and 17 extending rearwardly from an intermediate section 18 and 19 extending angularly and rearwardly upward to the rear of each of the arms 20 and 21 of each respective frame 10 and 12. Thus, when positioned in spaced apart side-by-side relation there are two equal rearwardly extending feet 16 and 17 to form a base and two equal forwardly extending arms 20 and 21 from which depend the bags B to be stored and the bag A to be opened, filled and sealed in desired succession.

Figure 7:
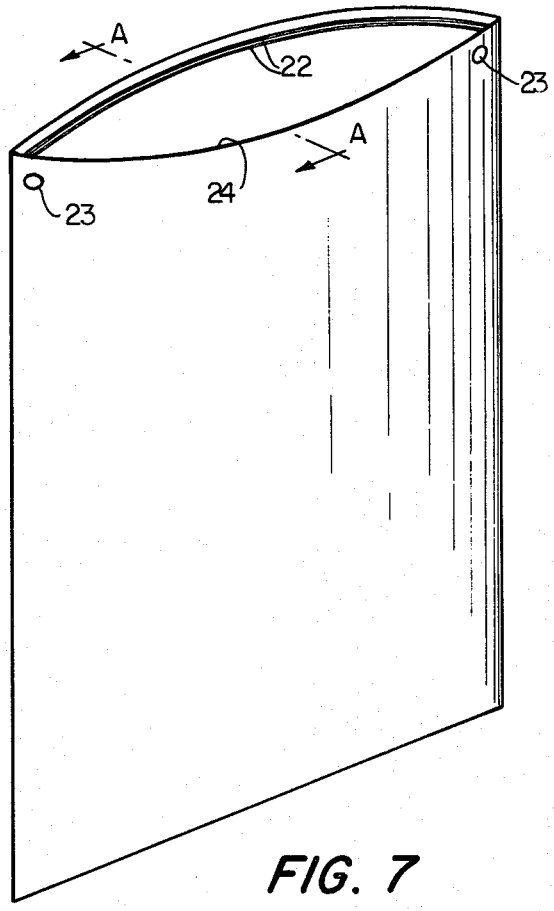
FIGS. 7 and 7*a* are general perspective views of a form of bag used with bag frame support arms showing the closure fastener formed along the lip edge of the mouth of the bag and formed at each corner of the mouth with suspending openings for cooperation with the projecting support arms.
Figure 7A:
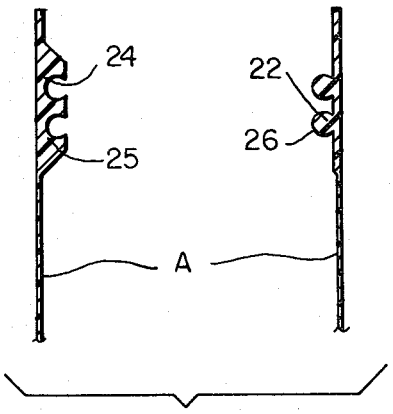

In reference to FIGS. 7 and 7*a*, it is to be noted that the bags used are not of the guzzet type, but are bags preferably of plastic formed with relatively thicker lips 22 and 24 at the mouth and are provided with a spaced opening 23 at each end. Such bags are provided with a pair of tongue and groove fastener parts 25 and 26 formed in the opposed thicker lips 22 and 24. Also, the lips 22 and 24 have sufficient rigidity and resiliency to become bowed to open the mouth of a bag carried by the arms 20 and 21 when compressed by the arms 20 and 21 at the supporting; when they are moved inwardly toward each other.

Further with reference to FIG. 1, it is to be understood that the spaced feet of the bag support are turned inwardly toward each other at their rear ends in aligned position to provide connector studs 27, 28 to receive the stabilizer and connector rod 14 formed at each opposite end with a socket 30 and set screw 32. When the rod 14 is coupled with the studs 27 and 28, it may be laterally adjusted and locked into position by the set screws at each end to accomodate for bag widths to be encountered.

Figure 4:
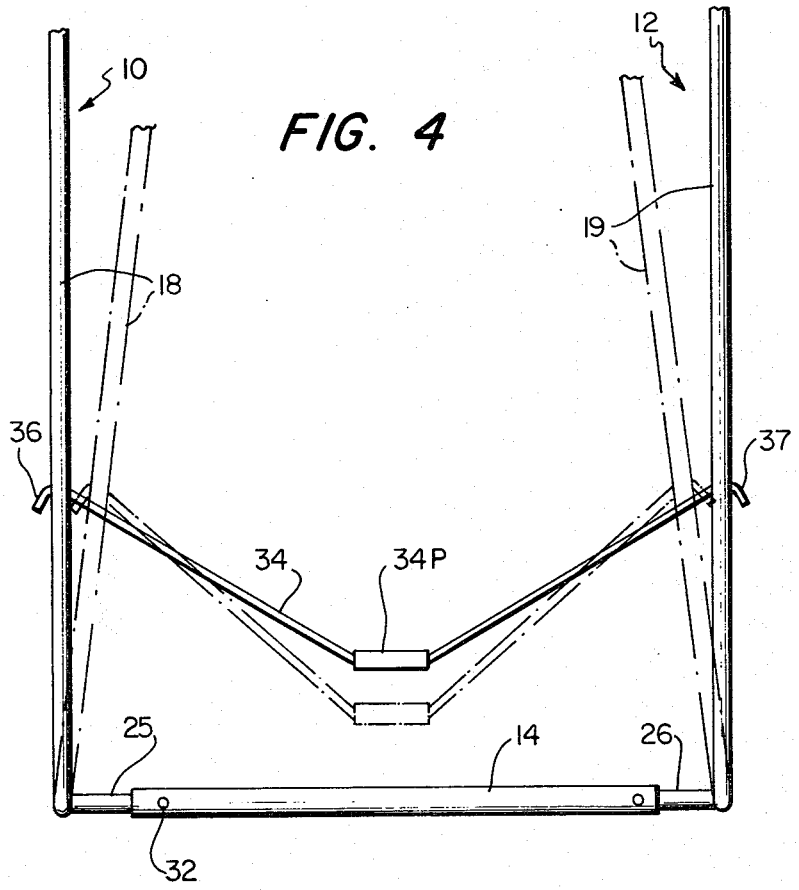
FIG. 4 is a partial cut-away view of a bag support structure base illustrating a pedal linkage for facilitating the opening of a bag.
Figure 5:
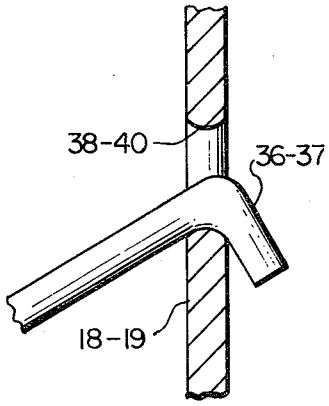
FIG. 5 is an enlarged view of an end of the pedal linkage of FIG. 4.

FIGS. 4 and 5 illustrate a preferred embodiment of the present invention including transverse peddle actuator bar 34 for moving the intermediate portion of the side frame sections 18 and 19 to import movement to bag support arms 20 and 21 inwardly toward each other for bag mouth manipulation. The movement imparted to the bag support arms is shown in dotted lines in FIGS. 4 and 5. Coupler ends 36 and 37 of the pedal bar 34 project into bearing openings 38 and 40 provided in each of the spaced side frames 10 and 12 to impart movement from the intermediate sections 18 and 19 of the side frames to the support arms 20 and 21 at the top of the respective side frames when pedal 34P is depressed.

Figure 3:
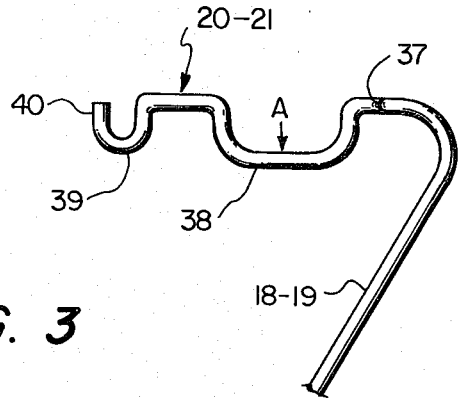
FIG. 3 is a side elevation of one of the bag holding arms with the dwell areas for the bags as depicted in FIG. 2.
Figure 2:
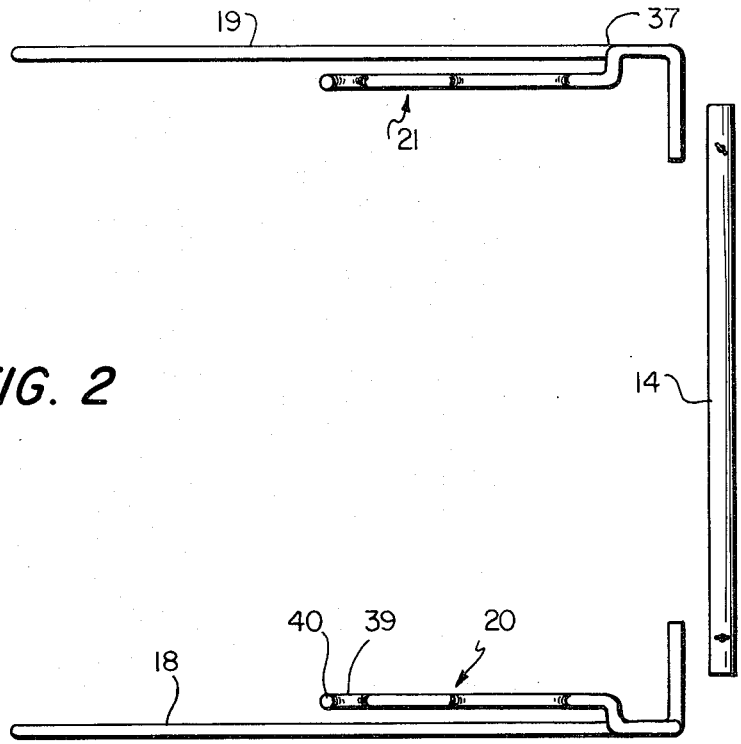
FIG. 2 is a top plan view of a bag holder side frames showing dwell areas for extra bags formed in the bag holding arms.

In FIGS. 2 and 3, there is shown another embodiment of the bag support arms 20 and 21. Each of the arms have a specific configuration extending from an offset 37 inward of the frame sides into a first downward bend 38 and then extend to a second bend 39 to provide a bag holder book 40 at the terminal end of the same. Extra bags are stored at bend 38 and are moved to hooks 40 when needed.

Figure 6:
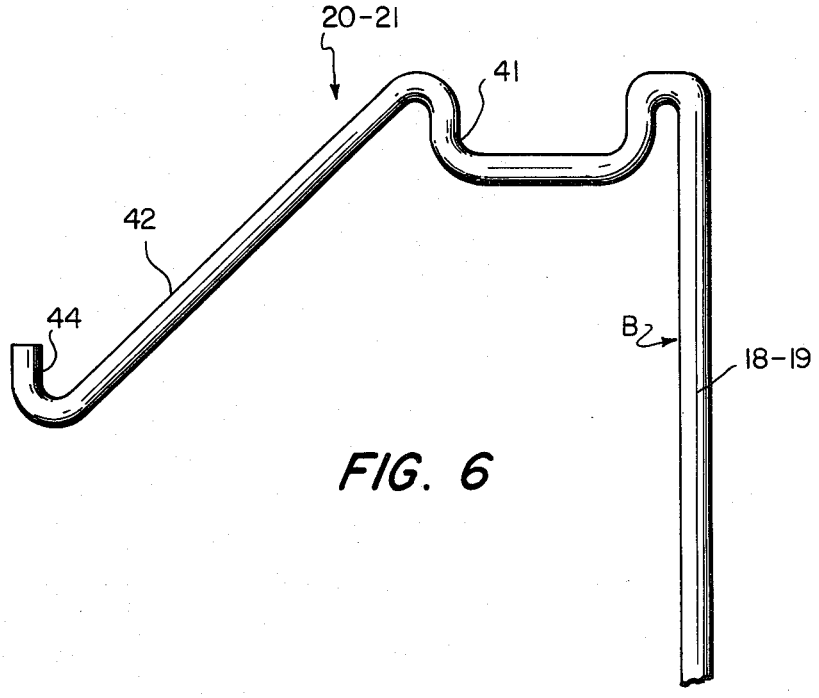
FIG. 6 is a side view of a preferred embodiment of one of the bag support's forward projecting bag hanger arms showing a well formation for containing extra bags at the rear thereof and a ramp portion to slide an extra bag from the well into bag filling position at the hook provided at the terminal end of the arm.

Now with reference to FIG. 6 another embodiment of the projecting bag support arms 20 and 21 is shown. Each arm is formed with a well or depression 41 to receive the extra bags and with a bag feeder ramp section 42 leading into an up-standing bag holder hook 44 to provide a bag loading station. The hooks 44 project into the corner openings 23 of bag A which will part the bag mouth lips 22 and 24 as shown in FIG. 7 when the arms 20 and 21 are moved toward each other.

Figure 8:
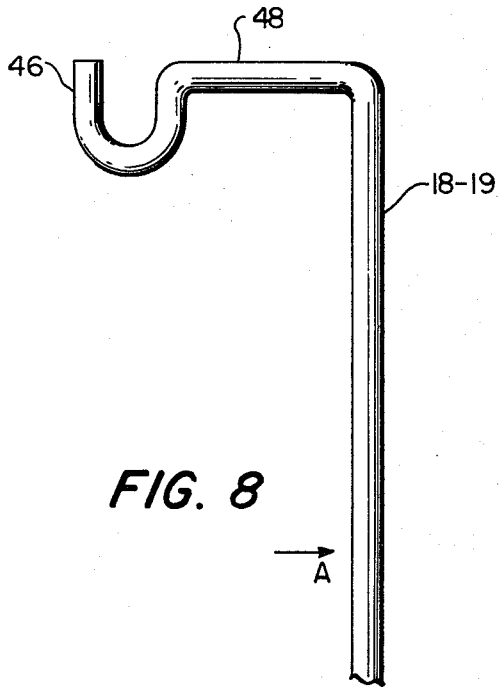
FIG. 8 is another embodiment of the bag support arms as described in more detail hereinafter.

Another embodiment of bag support arm is shown in FIG. 8 formed with a front up-standing hook 46 and a rear straight section 48 on which are strung a stack of extra bags when their respective openings are aligned for successive use.

The side frame configurations of FIGS. 6 and 8 may be formed at the top of the Z-shaped members of the frame of FIG. 1. However, if desired they may be rigidly mounted to any suitable support structure.

Figure 9:
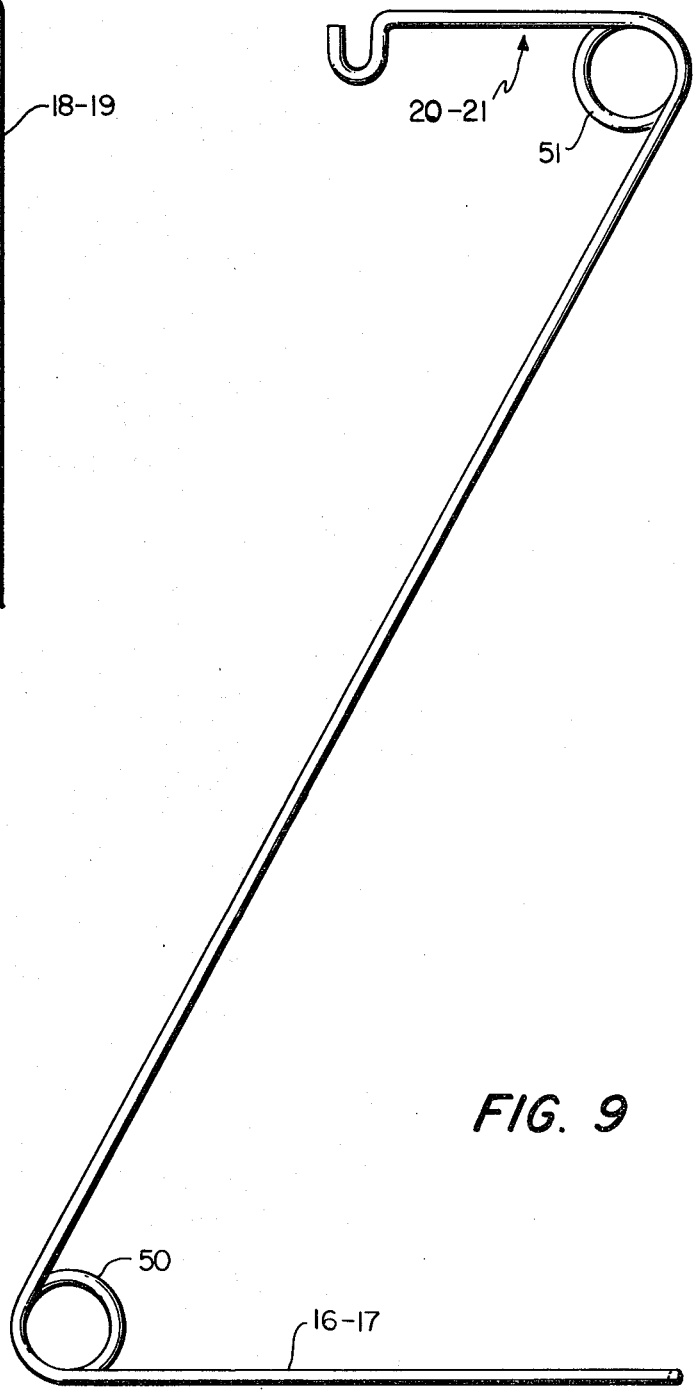
FIG. 9 is a perspective view of a further embodiment of the bag frame shown in FIG. 1.

Another modification of the invention is shown in FIG. 9. This embodiment is structurally the same as FIG. 1. Except in FIG. 9 the support arms and the feet of the bag support are made more yieldable and resilient at the bends of the side frames to the feet and arms of the bag support. For example, each continuous bend of the respective side frames may be in the form of coil springs 50 and 51 to provide spring joint connections to the feet 16 and 17 and to the bag suspension arms 20 and 21.

Without further description it is believed that the advantages of the present invention over the prior art are apparent and while only several preferred embodiments of the same are illustrated and described, it is to be expressly understood that the same is not limited thereto as various changes may be made in the combination and arrangement of the parts illustrated, as will now likely appear to others and those skilled in the art.

What is claimed is:

1. In combination a flexible bag having a mouth, and a frame means for supporting said bag and holding said mouth in an open position to facilitate the loading of articles through said mouth into said bag, the improvement comprising:

said frame means including a pair of side frames with support means for holding said bag at two diametrically opposed positions on said bag mouth;

transverse linkage means between said side frames;

pedal means associated with said transverse linkage means for pulling said side frames toward each other in response to an actuating force on said pedal means to thereby bow open said bag mouth.

2. The combination of claim 1 wherein each of said side frames includes relatively larger supporting feet at the base and relatively smaller bag suspension and dispenser arms forwardly extended above the said larger feet;

the arms and feet of each of said side frames being formed with a continuous Z-shape, said feet being formed with inturned aligned spaced connector ends;

a tubular connecting bar coupled at each end with one of said aligned inturned connector ends of said feet. whereby said larger feet at the base rest upon a level planar surface and permit said bag suspension arms to extend forward above said feet of the base.

3. The combination of claim 2, wherein said arms of each side frame are formed to define an inboard storage bag magazine for suspended extra bags and are formed with hook means at their respective outboard ends for engagement with spaced openings formed in the top edges of the mouth of said bags supported by said arms.

4. The combination of claim 2, wherein the said arms are continuous slanted formations form the bag magazine of each respective arm to the front hook means.

5. The combination of claim 2 wherein said Z-shaped side frames include coil portions at bends in said frame members forming said Z-shape.

6. The combination of claim 1 wherein said bag mouth has a stiffener means therein.

7. The combination of claim 6 wherein said stiffener means comprises an integral zipper formed in said mouth.

* * * * *